US008383224B2

(12) United States Patent
Heal

(10) Patent No.: US 8,383,224 B2
(45) Date of Patent: Feb. 26, 2013

(54) EXTENDED TABLE PAD ASSEMBLY

(75) Inventor: Gary Heal, Lagrange, IN (US)

(73) Assignee: Ohio Table Pad Company, Perrysburg, OH (US)

( * ) Notice: Subject to any disclaimer, the term of this patent is extended or adjusted under 35 U.S.C. 154(b) by 240 days.

(21) Appl. No.: 12/658,292

(22) Filed: Feb. 8, 2010

(65) Prior Publication Data

US 2010/0209656 A1 Aug. 19, 2010

Related U.S. Application Data

(60) Provisional application No. 61/207,893, filed on Feb. 18, 2009.

(51) Int. Cl.
*B32B 3/06* (2006.01)
*A47G 23/03* (2006.01)

(52) U.S. Cl. ..... 428/67; 108/90; 108/155; 108/158

(58) Field of Classification Search ..... 428/67, 428/99, 138; 108/90, 69, 158, 155, 156; 248/346.01, 346.3; 160/231.1
See application file for complete search history.

(56) References Cited

U.S. PATENT DOCUMENTS

| | | | | |
|---|---|---|---|---|
| 2,650,148 | A * | 8/1953 | Streng | 108/155 |
| 4,517,232 | A | 5/1985 | Krauser | |
| 5,476,701 | A | 12/1995 | Berger | |
| 6,165,577 | A | 12/2000 | Berger | |
| 6,919,116 | B2 | 7/2005 | Heal et al. | |
| 7,018,693 | B1 | 3/2006 | Heal et al. | |

* cited by examiner

*Primary Examiner* — Alexander Thomas
(74) *Attorney, Agent, or Firm* — Marshall & Melhorn, LLC

(57) ABSTRACT

A table pad assembly having at least one table pad end section that extends beyond the longitudinal edge of a table top. In addition to the table pad end section, the assembly includes at least two brackets each having a female attaching portion and a base portion, at least one spline having a first opening and a second opening, at least a set of legs, and an adjustable foot on each leg.

4 Claims, 5 Drawing Sheets

EXTENDED TABLE PAD ASSEMBLY

RELATED APPLICATIONS

This application is a non-provisional application filed off of U.S. patent application Ser. No. 61/207,893 filed on Feb. 18, 2009, which is incorporated by reference in its entirety herein. This non-provisional is being filed during the pendency of U.S. patent application Ser. No. 61/207,893.

FIELD OF THE INVENTION

The present invention relates to a protective table pad assembly, specifically to a table pad which extends beyond the longitudinal edge or edges of a table top.

BACKGROUND OF THE INVENTION

Tables and their complimentary table pads are known in the art and are available from many sources. One embodiment of a table 10 and a table pad 12 is depicted in FIG. 1. Tables and table pads are manufactured to standard sizes, as well as custom sizes. Table pads are generally selected based on a number of factors including the size of the table and the area and activities for which, and where, the table will be used. Table pads are used primarily for the protection of wooden tabletops and normally have a cushioned or soft bottom surface for contact with the tabletop. Table pads also normally have a harder more resilient outer upper surface that often is water resistant to resist moisture damage.

Often the table available to a group or individual is not shaped appropriately or large enough to accommodate the circumstances. Traditionally, this has required using an alternative table or locating one or more additional tables. However, finding another table can be costly and time consuming, whereas, using two tables separately or in combination may also be problematic. For example, when two tables are placed side-by-side to form one larger structure and each table has a different height, an undesirable non-uniform structure is created. Thus an advantage of the present invention is that it provides an efficient way to create a uniform surface that is larger than the tabletop upon which it partially rests.

SUMMARY OF THE INVENTION

The present invention is directed toward a table pad assembly having at least one table pad center section and at least one table pad end section extending longitudinally beyond one longitudinal edge of a table top. The two table pad sections are connected using a mechanical interlocking system.

The table pad end section includes a spline having a first portion and a second portion. The spline contacts the bottom surface of the end section and extends latitudinally across a mid-point of the end section. The spline also has openings in either end, and the openings facilitate a place for attaching at least one bracket and at least one leg to the end section.

The bracket has a female attaching portion and a base portion. The leg has a first end portion, a body, and a second end portion, wherein the first end portion includes a male attaching portion for attaching to the bottom surface of the table pad end section. The second end portion of the leg comprises an insert and an adjustable foot.

In accordance with the present invention, it has been discovered that a table pad assembly can provide an extended surface area than that of an already available table. A further advantage is the uniform surface area created by the table pad.

BRIEF DESCRIPTION OF THE DRAWINGS

The above, as well as other advantages of the present invention will become readily apparent to those skilled in the art from the following detailed description when considered in light of the accompanying drawings in which.

DETAILED DESCRIPTION OF THE PREFERRED EMBODIMENTS

It is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions, directions or other physical characteristics relating to the embodiments disclosed are not to be considered as limiting, unless the claims expressly state otherwise. Additionally, although the invention will be described in connection with a table, it would be understood by one of ordinary skill in the art that the table pad assembly described herein has applications to other furniture requiring a covered surface.

Figure 1:
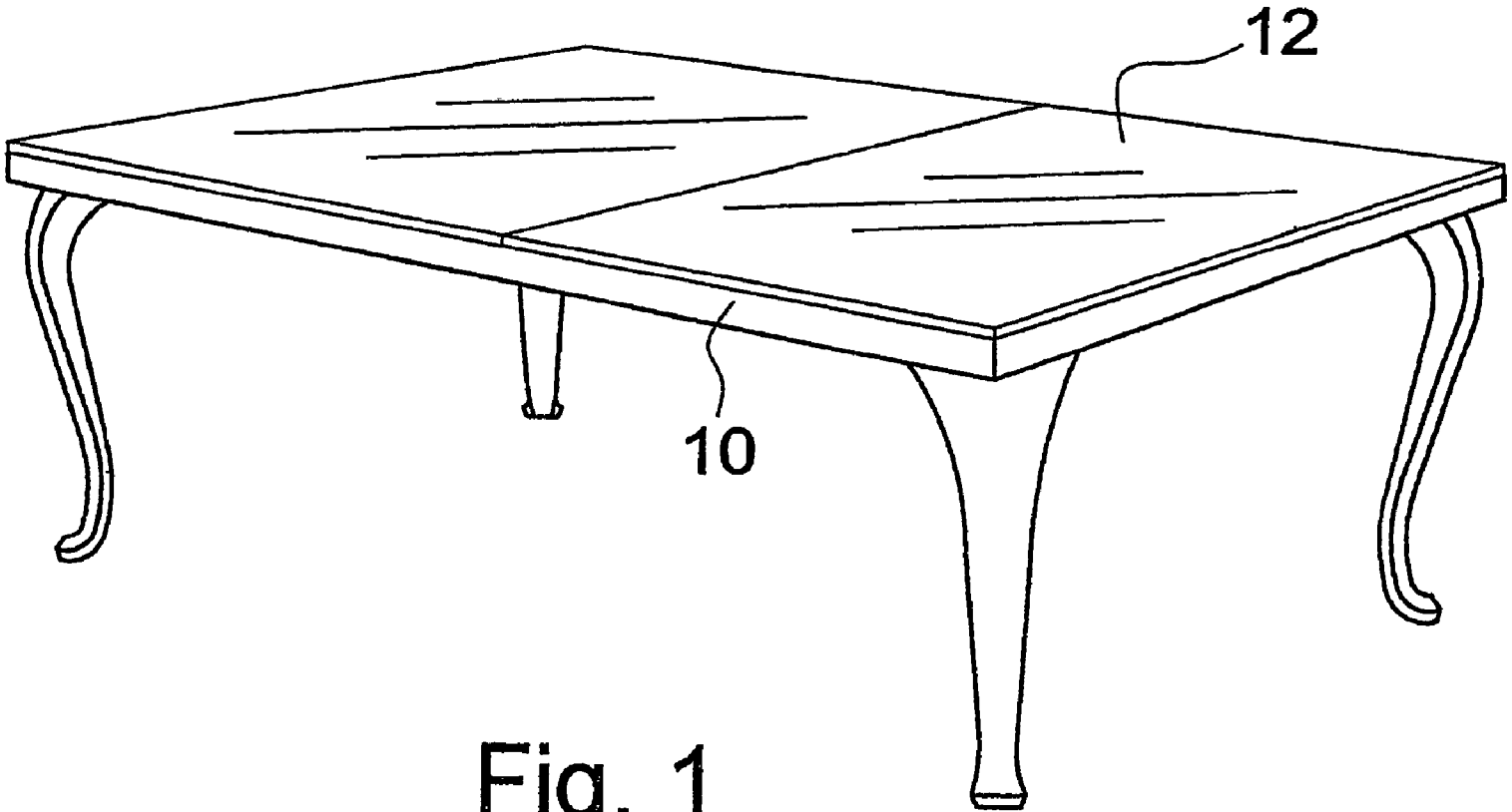
Fig. 1 Prior Art
FIG. 1 is a perspective view of a table and a prior art table pad.
Figure 2:
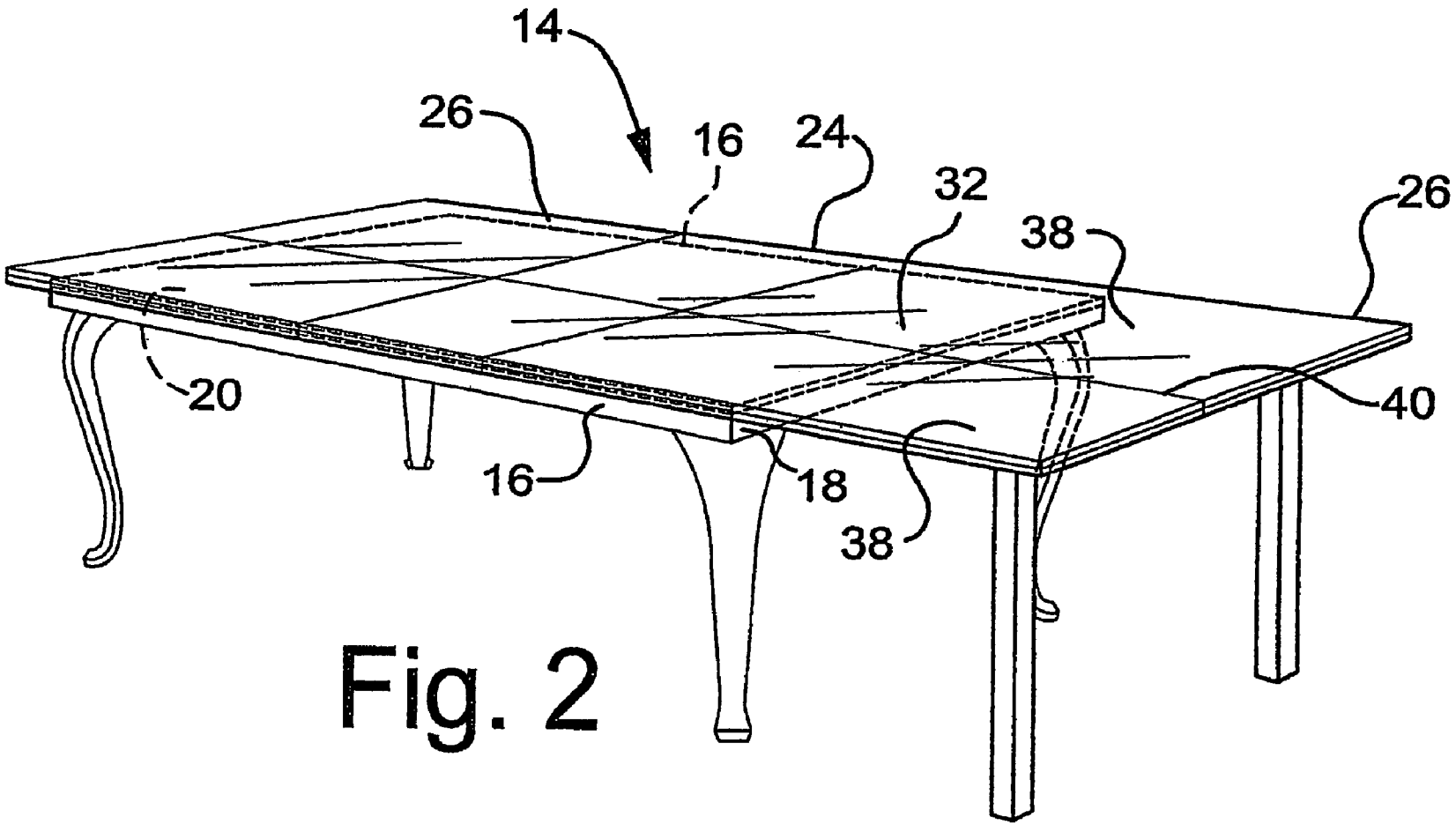
FIG. 2 is a perspective view of a table and an embodiment of the table pad assembly of the present invention.
Figure 3:
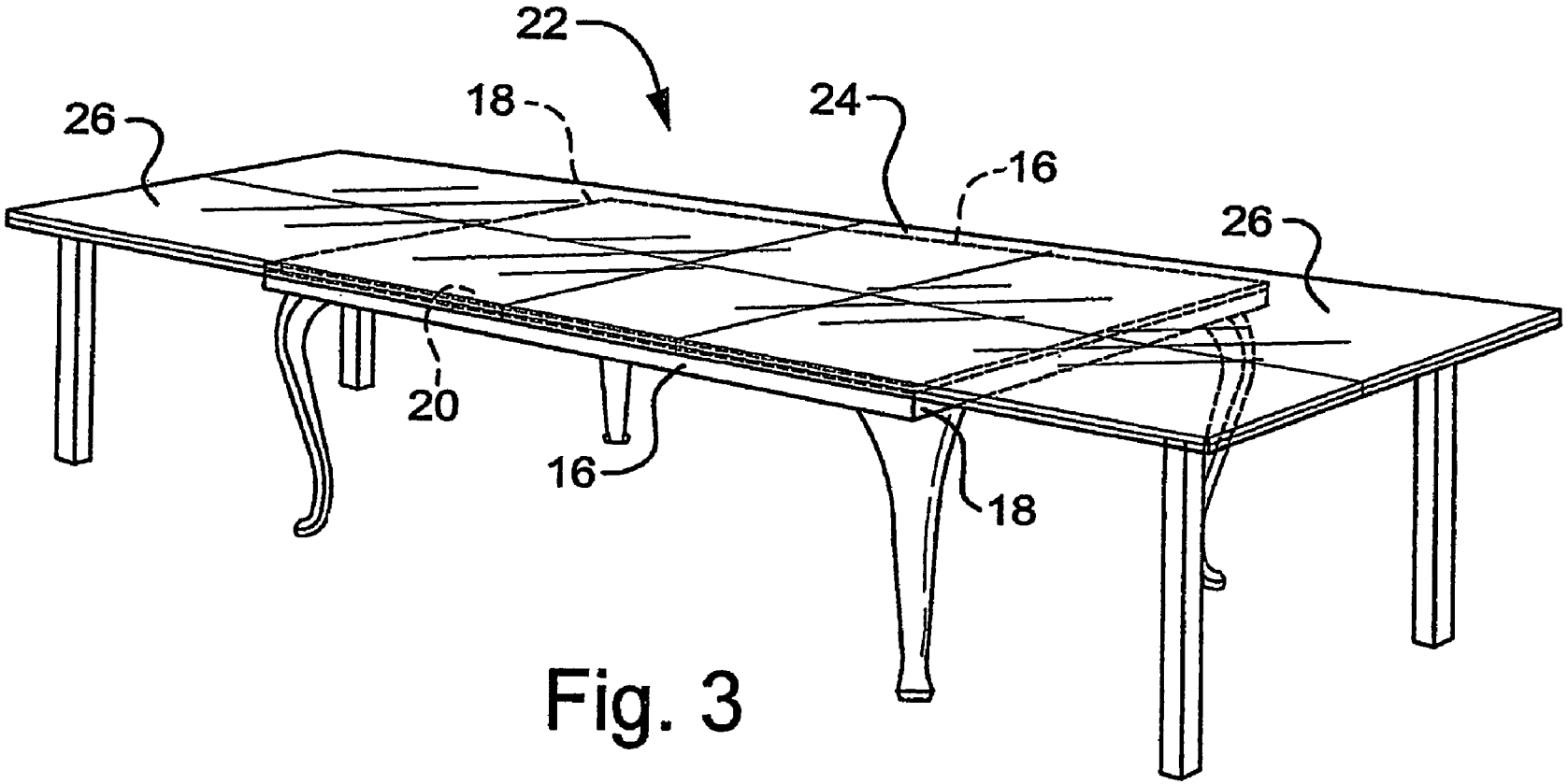
FIG. 3 is a perspective view of a table and another embodiment of the table pad assembly of the present invention.

FIGS. 2 and 3 depict two embodiments of table pad assemblies of the present invention. FIG. 2 shows one embodiment where a table pad assembly 14 extends over both latitudinal edges 16 and at least one longitudinal edge 18 of a rectangular tabletop 20. FIG. 3 shows another embodiment where a table pad assembly 22 extends over both latitudinal edges 16 and both longitudinal edges 18 of a rectangular tabletop 20.

As shown in FIGS. 2 and 3, the table pad assemblies 14, 22 of the present invention may comprise at least one table pad center section 24. Additionally, the table pad assemblies 14, 22 of the present invention comprise at least one table pad end section 26 which extends beyond one longitudinal edge 18 of the tabletop 20. Table pad sections 24, 26 of the present invention have a generally rectangular shape. However, it is also possible to practice the present invention using sections 24, 26 having a circular, semi-circular, or other curvilinear shapes. It is also possible to practice the present invention using a combination of shaped sections as part of the same assembly.

Circular and semi-circular sections are measured by their radius and thickness. Rectangular sections can be measured by their length, width, and thickness. The thickness of the table pad assemblies 14, 22 of the present invention can vary from table pad assembly to table pad assembly. Generally, the range is from ¼ to 1.5 inches. A preferred thickness of the table pad is ¾ of an inch thick.

Figure 4B:
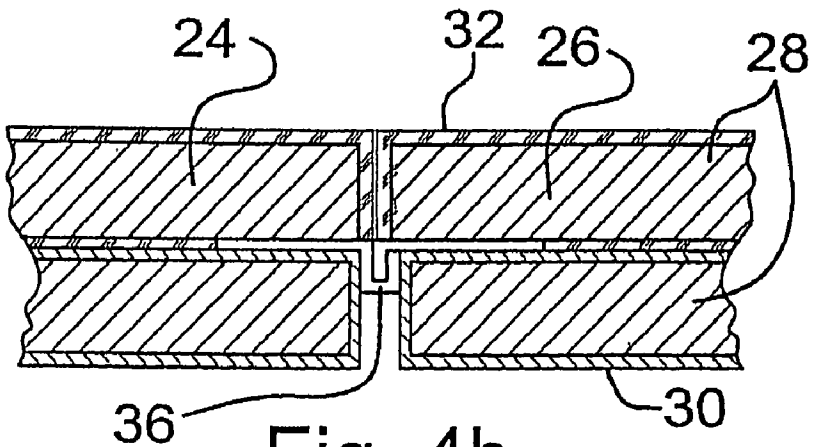
FIG. 4*b* is a fragmentary, side view showing a mechanical interlocking table pad section joining system.

As can be appreciated from FIG. 4, table pad thickness is primarily determined by the amount of inner material 28 placed between the bottom surface 30 and outer upper surface 32. The inner material 28 is generally a resilient planar material. Traditionally, the inner material is comprised of board, such as a solid wood or particle board, but it can also be other planar resilient materials known to those having skill in the art. Depending on the thickness required, multiple pieces of board may be utilized.

Regardless of its shape or thickness, each table pad section 24, 26 has a bottom surface 30 and an outer upper surface 32. The bottom surface 30, shown in FIGS. 4 and 5, is generally soft for contact with the tabletop 20 and may be felt or fabric. The outer upper surface 32, shown in FIGS. 2-4, is generally made of a harder material. In one embodiment the outer upper surface 32 is colored vinyl.

The number of table pad sections 24, 26 comprising the present invention may vary depending on the size of the table, the size of the sections, and/or the desired increase in surface area. If multiple sections 24, 26 are used it may be preferable that the sections 24, 26 are joined, although they need not be to practice the present invention. As shown in FIG. 4, there are several preferred systems for joining multiple section assemblies. All achieve a flat planar outer upper surface 32.

Figure 4A:
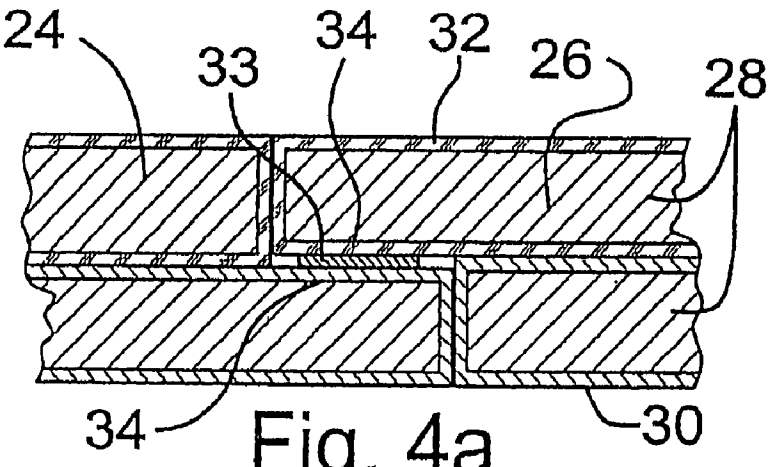
FIG. 4*a* is a fragmentary, side view showing a flanged table pad section joining system.
Figure 5:
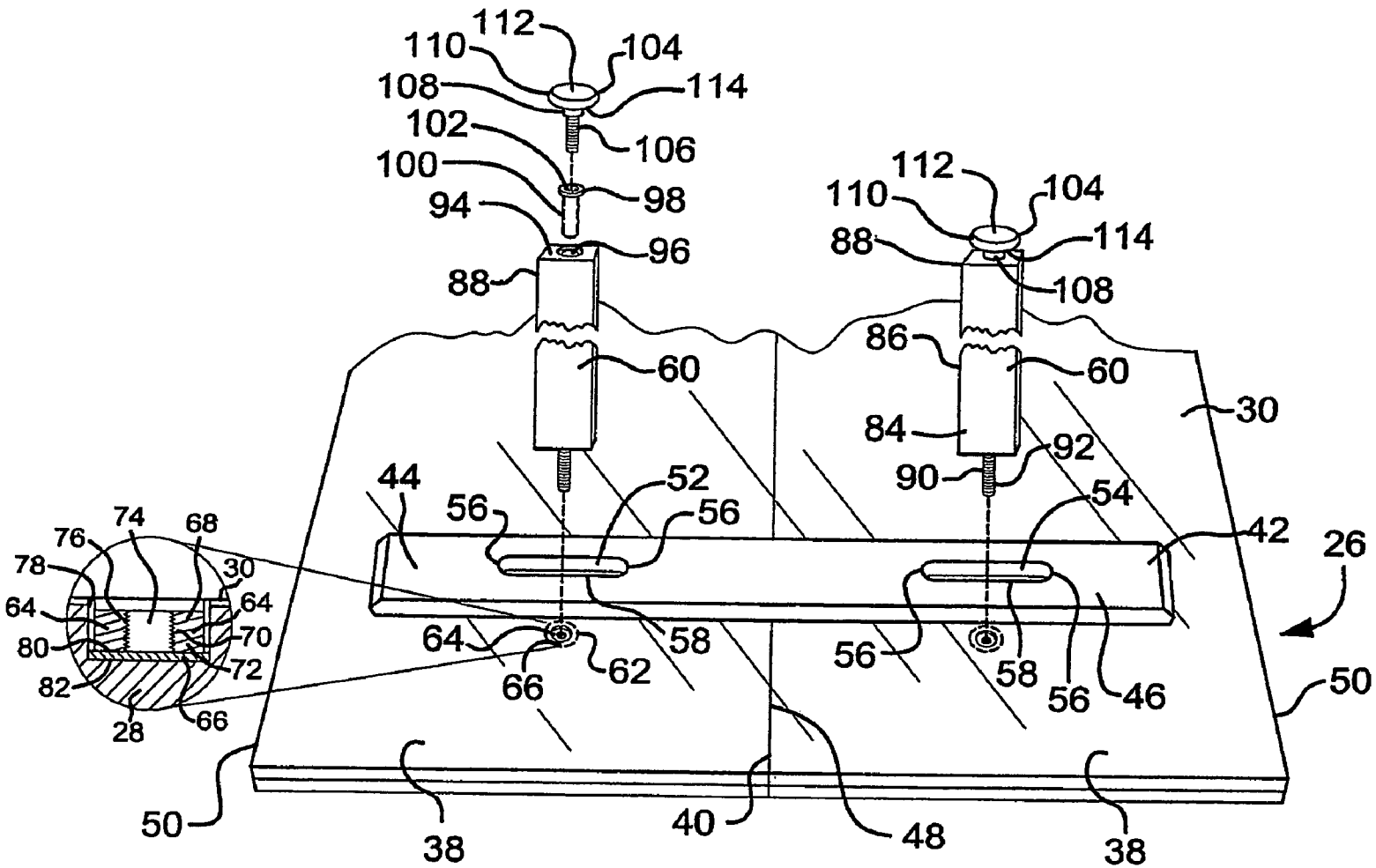
FIG. 5 is an exploded perspective view of the bottom surface of a table pad end section and a detailed side view of a portion of the present invention.

In one embodiment, like the one shown in FIG. 4*a*, sections 24, 26 may be joined using hook and loop fasteners 33. In this embodiment, the inner planar materials 28 are offset in each section 24, 26 to produce overlapping flanges 34. The flanges 34 are routered to accommodate hook and loop fasteners 33. When the flanges 34 are aligned the hook and loop fasteners 33 engage which joins the assembly to create a substantially smooth upper surface 32. In another embodiment, it may be preferable to join sections 24, 26 by a mechanical interlocking system 36 like the one described in U.S. Pat. No. 4,517,232, which is hereby fully incorporated by reference, and depicted in FIG. 4*b*. Those skilled in the art would understand that these systems can be used separately or in combination. Also, those having ordinary skill in the art would appreciate that other coupling systems are known in the art. While not contemplated to be used in the present invention, one such system is disclosed in U.S. Pat. No. 6,165,577.

Regardless of the number of table pad sections 24, 26 and the means by which they are joined, each section 24, 26 is preferably partitioned. As shown in FIG. 2, partitioning is preferably done so that two substantially equal halves 38 are created. When a section 24, 26 is partitioned and covered by the bottom surface material and upper outer surface material, a foldable crease 40 is created. Each half 38 is foldable along the crease 40 so that it can collapse into a smaller unit for storage and/or for easier transport. Those skilled in the art would recognize that although it is preferable to partition, sections need not be partitioned to practice the present invention.

When the present invention is being utilized, each table pad section 24, 26 is positioned above the tabletop 20 so that at least a portion of each section's bottom surface 30 directly contacts the tabletop 20. However, when multiple sections are required, the amount of contact may vary by section. The amount of contact generally depends on the location of the section 24, 26. As shown in FIGS. 2 and 3, when multiple sections are used, a center section 24 may be fully supported longitudinally by the table top 20, whereas an end section 26 may or may not be fully supported. Preferably, at least one of the table pad end sections 26 in an assembly will not be fully supported longitudinally by the tabletop 20. If an end section 26 is not fully supported longitudinally, as shown in FIGS. 2 and 3, it is preferable that between 4 and 24 inches of longitudinal contact exist between the tabletop 20 and the end section's bottom surface 30. In one embodiment, 12 inches of longitudinal contact exists between the tabletop 20 and the end section's bottom surface 30.

As shown in FIG. 5, if a table pad end section 26 extends beyond the longitudinal edge 18 of the tabletop 20, it may preferably be supported by a spline 42. The spline 42 has a first portion 44 and a second portion 46 each having at least one planar surface. The spline 42 contacts the bottom surface 30 of the pad section 26 and extends latitudinally across the mid-point 48 of the end section 26. If an end section 26 has been partitioned so that a crease 40 exists, the spline 42 extends from one section half 38 across the crease 40 to the other half 38. However, in either case, the spline 42 need not extend from one latitudinal edge 50 of the table pad end section 26 to the other.

The spline 42 is made from a resilient material, preferably wood. The spline 42 includes a first opening 52 and a second opening 54 that both extend therethrough. The first opening 52 is located in the first portion 44. The shape of the first opening 52 can vary greatly. For instance, the first opening 52 can have a rectangular shape or it can be shaped like a circle or ellipse. As shown in FIG. 5, the first opening 52 could also be a combination of those shapes. The second opening 54 is located in the second portion 46. The shape of the second opening 54 may also vary greatly like the first opening 52.

As shown in FIG. 5, the first opening 52 and second opening 54 can have substantially similar shapes. In one embodiment, both the first opening 52 and the second opening 54 extend across at least one third of their respective portions 44, 46. In this embodiment, the first opening 52 and the second opening 54 have semicircular end portions 56 connected together by a rectangular center portion 58. This embodiment enables the spline 42 to be used with table pad end sections 26 of varying widths without having to adjust the size of the openings 52, 54. Other lengths for the first opening 52 and the second opening 54 can also be used to practice the present invention. However, the size and shape of the first opening 52 and second opening 54 must be such that the spline 42 can be fixedly positioned to contact the bottom surface 30 of a table pad end section 26 by a leg 60 and a bracket 62.

The bracket 62 comprises a female attaching portion 64 and a base portion 66. The bracket 62 is connected to the table pad end section 26 by the base portion 66, such that the bracket 62 is recessed within the table pad end section 26. The female attaching portion 64 and the base portion 66 are both made from a resilient material which is preferably metal. The female attaching portion 64 has a receiving end portion 68, a body 70, an exit end portion 72, and an orifice 74. The orifice 74 is located in the center of the female attaching portion 64 and extends from the receiving end portion 68 through the body 70 to the exit end portion 72. The orifice 74 preferably has threads 76 located therein. In one embodiment, the female attaching portion 64 is a threaded nut. The female attaching portion 64 is oriented so that the receiving end portion 68 is not obstructed by the end section 26. In one embodiment, the receiving end portion 68 is located in an opening 78 in the bottom surface 30 of the end section 26.

The female attaching portion 64 is connected to the base portion 66 at its exit end portion 72. The base portion 66 has a first surface 80 and a second surface 82. In one embodiment, the base portion 66 is a plate. The first surface 80 is connected to the female attaching portion 64 and the second surface 82 is connected to the table pad end section 26. The female attaching portion 64 can be connected to the base portion 66 mechanically, by an adhesive, by welding or other commonly known ways of attaching similar materials in the art. The base portion 66 is connected to the exit end portion 72 of the female attaching portion 64. In one embodiment, the base portion 66 is connected on its second surface 82 to the inner pad material 28 of the end section 26.

The table pad assemblies 14, 22 of the present invention also comprise at least a set of legs. FIG. 3 shows an embodiment where the table pad assembly comprises two sets of legs. As shown in FIG. 5, each set of legs comprises two legs. Each leg 60 is made from a resilient material, preferably wood. Each leg 60 comprises a first end portion 84, a body 86, and a second end portion 88. The first end portion 84 includes a male attaching portion 90 which extends out from the surface of the first end portion 84. The length of the male attaching portion 90 is preferably greater than the thickness of the spline 42.

It is preferable that the leg 60 and the bracket 62 are mechanically coupled. Thus, the male attaching portion 90 may preferably be a threaded stud having threads 92 which compliment those in the orifice 74 of female attaching portion 64. The travel of the male attaching portion 90 through the female attaching portion 64 is limited by the thickness of the spline 42 so that the bottom surface 30 of the table pad end section 26 and/or the inner pad material 28 is not damaged during assembly. However, to ensure that no damage occurs when connecting the male attaching portion 90 to the female attaching portion 64, in one embodiment the base portion 66 obstructs the orifice 74.

The second end portion 88 of the leg 60 has a flat surface 94 and a circular cavity 96 positioned therein. An insert 98 is fixedly positioned in the cavity 96. The insert 98 can be fixedly positioned in the cavity 96 mechanically and/or can be adhered to the cavity walls. The insert 98 comprises a body 100 and an inner threaded orifice 102 disposed therethrough. The inner threaded orifice 102 allows each leg 60 to connect to an adjustable foot 104.

Each adjustable foot 104 comprises an adjustment thread 106, a spacer 108, and a base 110. The base 110 is made of a resilient material and has a first side 112 and a second side 114. The first side 112 contacts the floor surface. The spacer 108, which is connected to the second side 114 of the base 110, limits the travel of the adjustment thread 106 into the insert 98. The adjustment thread 106, which is concentric with the spacer 108 and the base 110, allows the foot height to be changed while the foot 104 remains connected to the leg 60.

Upon assembly, the embodiments of the present invention provide a table pad assembly capable of supporting objects or things having mass placed on its upper surface 32.

In accordance with the provisions of the patent statutes, the present invention has been disclosed in what are considered to represent its preferred embodiments. However, it should be noted that the invention can be practiced otherwise than as specifically illustrated and described without departing from its spirit or scope.

What is claimed is:

1. A table pad assembly, comprising:

a table pad having a crease, an upper surface and a lower surface;

a spline connected to said lower surface, said spline comprising at least one opening extending through said spline, and said spline extends from one section half of said table pad across said crease to another section half of said table pad; and at least one bracket located within said lower surface, said bracket comprising an attaching portion defining an orifice bounded by threads, said bracket being substantially flush with said lower surface;

wherein said at least one opening in said spline is aligned with said orifice in said bracket.

2. The table pad assembly as defined in claim 1, further comprises at least two legs, each of said legs comprises a first end portion, a body portion, and a second end portion, said first end portion includes a male attaching portion, said male attaching portion extends through said spline opening for attaching to said lower surface of said table pad.

3. The table pad assembly as defined in claim 2, wherein said legs are mechanically coupled to said brackets, wherein one leg and one bracket are on one side of said crease and one leg and one bracket are on the opposite side of said crease.

4. The table pad assembly as defined in claim 1, wherein each of said upper and lower surfaces extend beyond the longitudinal edge of a table top.

* * * * *